United States Patent [19]

Baker et al.

[11] Patent Number: 5,076,173

[45] Date of Patent: Dec. 31, 1991

[54] LIFTING HOOK ARRANGEMENT FOR RAILWAY TANK CAR

[75] Inventors: Thomas B. Baker; John A. Krug, both of County of St. Charles, Mo.

[73] Assignee: ACF Industries, Incorporated, Earth City, Mo.

[21] Appl. No.: 572,698

[22] Filed: Aug. 27, 1990

[51] Int. Cl.[5] ..... B61K 5/00

[52] U.S. Cl. ..... 105/362

[58] Field of Search ..... 105/362, 462, 358, 355, 105/359, 360, 236; 294/74, 67.4

[56] References Cited

U.S. PATENT DOCUMENTS

| | | | |
|---|---|---|---|
| 1,100,405 | 6/1914 | Smith | 105/362 |
| 1,120,923 | 12/1914 | Frede | 105/362 |
| 3,352,590 | 11/1967 | Barthule | 294/74 |
| 4,557,199 | 12/1985 | Everett | 105/362 |
| 4,805,540 | 2/1989 | Mundlock et al. | 105/362 |

*Primary Examiner*—Robert J. Oberleitner
*Assistant Examiner*—Mark T. Le
*Attorney, Agent, or Firm*—Polster, Lieder, Woodruff and Lucchesi

[57] ABSTRACT

An improved bolster assembly (21) is for use on a railway tank car (T). The assembly comprises a vertical web member (23) the upper end of which is formed to fit about the outer surface of the shell (S) forming the tank. The member has a lifting hook opening (41) formed therein adjacent the outer end of the member. The size and orientation of the opening conform to the Association of American Railroads (AAR) design specifications for devices used in vertically lifting the car. Reinforcement plates (45*a*, 45*b*) are attached to at least one side of the web member, at the upper end thereof, to reinforce the member. The reinforcement plates are spaced from the opening and not adjacent thereto.

5 Claims, 2 Drawing Sheets

LIFTING HOOK ARRANGEMENT FOR RAILWAY TANK CAR

BACKGROUND OF THE INVENTION

This invention relates to the lifting of railway cars onto and off of railroad tracks, such movement usually being accomplished by lifting the car with a crane or the like, and, in particular, to an improved tank car bolster assembly incorporating a lifting hook hole arrangement by which one or more lifting hooks can be attached to the bolster assembly to lift a tank car.

Railroad tank cars, as well as other types of railroad cars, occasionally have to be lifted off the railroad tracks on which they rest; or, placed on the tracks as in the event of a derailment. To this end, the Association of American Railroads (AAR) design specifications for railcars require that means be provided by which a car can be vertically lifted on and off railroad tracks by a crane having a suitable cable/hook arrangement. Further, the AAR specifications require the lifting arrangement be located at or near each end of the car. One such arrangement is shown, for example, in U.S. Pat. No. 4,875,417, and in U.S. patent application Ser. No. 082,446, now U.S. Pat. No. 4,922,833 both of which are assigned to the same assignee as the present invention. The arrangement shown therein is for use on a covered hopper railway car in which a reinforced hook hole is incorporated in both of the outermost vertical members of a truss. This permits the vertical members to both be part of the truss assembly, and to also provide a lifting lug structure for receiving lifting hooks by which the car can be vertically lifted by a crane.

While the above mentioned co-assigned patent and patent application are directed to covered hopper cars, the AAR requirements also apply for railway tank cars. Heretofore, the lifting arrangement for tank cars has included openings incorporated in both sides of the car's bolster assemblies for receiving lifting hooks. These openings have been reinforced openings formed on each outer portion of the tank car bolster assemblies. Forming these reinforced openings has required a substantial amount of material and labor which has significantly added to the cost and weight of the car.

SUMMARY OF THE INVENTION

It is therefore an object of the present invention to provide an improved tank car bolster incorporating an opening on each side thereof for use with a cable/hook arrangement to lift the car.

Another object of the invention is to provide such an improved bolster assembly in which reinforcement of the opening is simplified to reduce the amount of material as well as the amount of man-hours required to fabricate the assembly, thus reducing the cost of the car and its weight.

Yet another object of the invention is to provide an improved bolster assembly which has a lower profile to make the application of the outside tank jacket easier.

A further object of the invention is to provide such an improved bolster which is a simpler and lighter structure than prior art bolsters, and in which the stresses which occur when the car is hoisted on and off railroad tracks are reduced.

In accordance with the invention, generally stated, an improved bolster assembly is provided for use on a railway tank car. The assembly comprises a vertical member on each side of the car the upper end of which is formed to fit about the outer surface of the shell forming the tank car tank. Each member has an opening formed therein adjacent the outer end of the member. The size and orientation of each opening conforms to the AAR design specifications for means to be used in vertically lifting the car. A reinforcement plate is attached to at least one side of each member, at the upper end thereof, to reinforce the member. The plate is spaced from the opening and is not contiguous therewith. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 5:
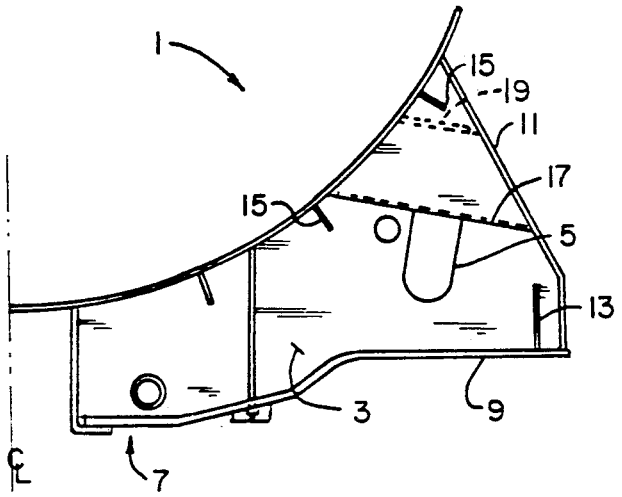
FIG. 5. PRIOR ART.

Referring to the drawings, a railway tank car T has an elongate tank shell S which defines the tank car tank or tank body. The tank has a valve assembly (not shown) on its roof R, the valve assembly being covered by a protective housing H. A stub sill SS is located at each end of the car as is a truck assembly TA mounted to the underside of the tank. The shell is supported at each end by a tank cradle TC which fits beneath the tank. Each cradle has a curved pad P oriented orthogonally to the transverse axis of the shell. Each cradle TC extends under the shells and upwardly about the sides of the tank. The upper ends of the cradle pads terminate below the centerline of the tank. The car further has a bolster assembly BA at each end upon which the pad, and hence the shell, are supported. The bolster assembly is, in turn, secured to its associated stub sill, by welding, to form an end structure weldment at each end of the car.

The Association of American Railroads (AAR) has established regulations which require that a tank car have means by which it can be lifted, at each end, so the car can be picked up from or set down upon railroad tracks. A track crane (not shown) is usually employed in this operation. The crane has a cable/hook lifting arrangement. Hooks are used to engage the car at one or both ends and to lift it. For this purpose, lifting hook openings are formed on both sides of the bolster assembly BA, at each end of the car, for lifting hooks to engage the assemblies.

Various types of lifting hook openings have been utilized in the past. See, for example, U.S. Pat. No. 4,875,417, and U.S. patent application Ser. No. 082,446, now U.S. Pat. No. 4,922,833, both of which are assigned to the same assignee as the present invention. The arrangements shown therein are for use on a covered hopper railway car, as opposed to railway tank cars. As shown in both of the above-noted co-assigned patent and patent application, a reinforced hook hole 101 (referring now to the reference characters in U.S. Pat. No. 4,875,417) is formed in both vertical members 69a', 69b' of a truss 33' which is part of a bolster assembly.

Figure 6:
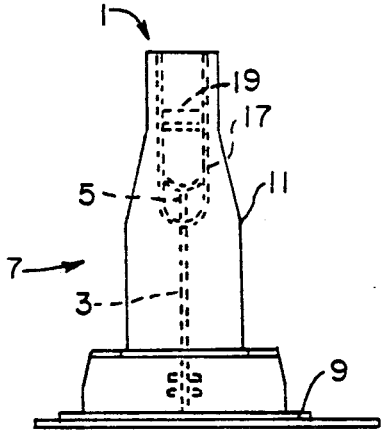
FIG. 6. PRIOR ART.
Figure 1:
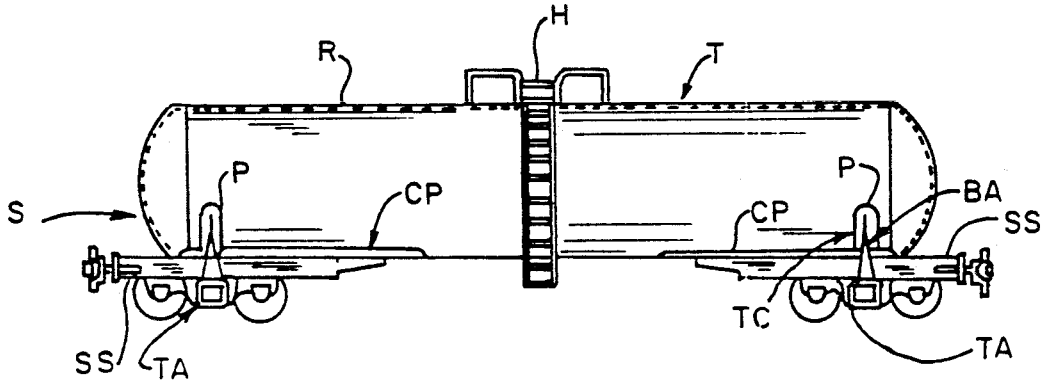
FIG. 1 is a side elevational view of a railway tank car having a bolster assembly at each end thereof.

Referring to FIGS. 5 and 6 herein, a prior art tank car bolster assembly 1 having a hook hole arrangement is designated generally 5. While only one side of the assembly is shown, it will be understood that both sides are of the same configuration. Assembly 1 is a so-called high profile assembly in that the assembly extends substantially upward along the sides of the tank car tank shell. A vertical bolster web 3 has an opening or hook hole 5 formed in it. The opening 5 is an elongate slot having a rounded lower end and an upper end which terminates at the upper end of the bolster web. The opening is formed approximately three-fourths the distance between the center line of the car and the outer end of the bolster assembly BA. The longitudinal axis of the opening 5 is offset from the vertical, but is within the AAR requirements for hook holes so a lifting hook can be readily set in the opening. The bolster assembly also includes a bottom bolster cover plate 9, a side cover plate 11, a gusset 13, and jacket flashing standoffs 15 secured to web 3. A U-shaped top web member 17 is attached (welded) to the upper end of the bolster web with the rounded lower end of the top web member 17 forming the upper end of opening 5. A reinforcement plate 19 is welded between the legs of the top web member. Top web member 17 thus forms a lifting lug for the tank car. While effective for its intended purpose, the above-described prior art lifting arrangement, shown in FIGS. 5 and 6, is heavy because, among other things, of the weight of member 17.

Figure 2:
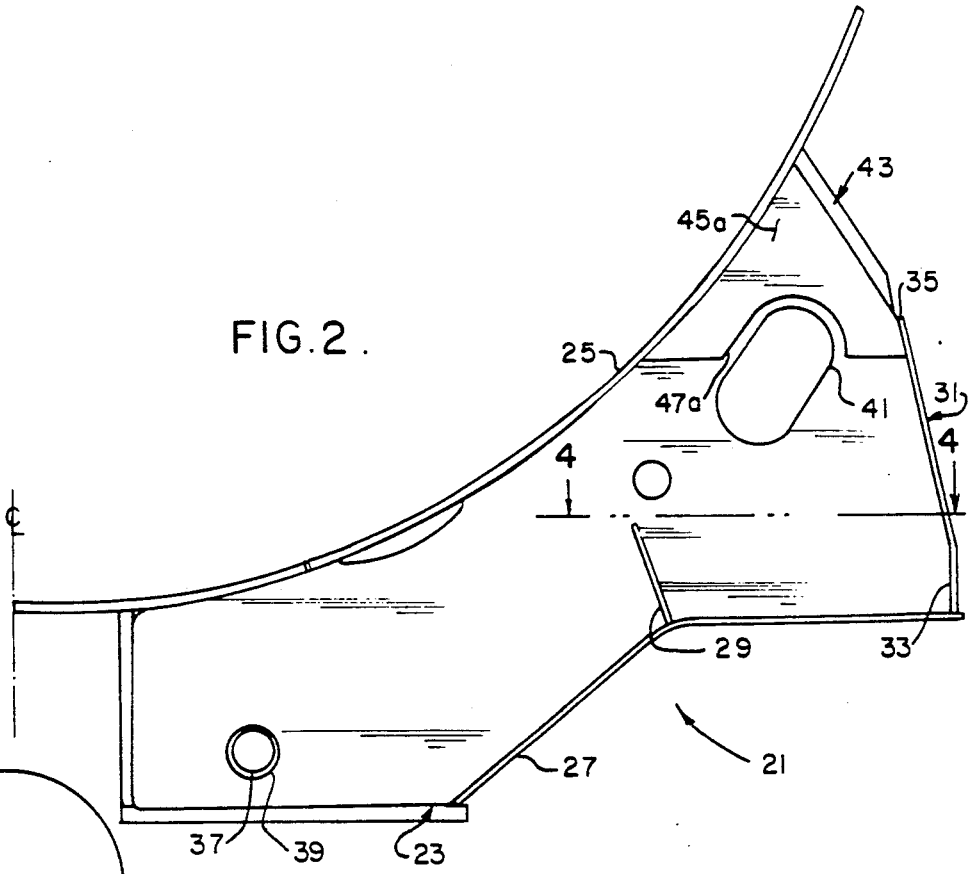
FIGS. 2 and 3 are respective enlarged scale front and side elevational views of one side of an improved bolster assembly of the present invention having an improved lifting hook arrangement of the present invention incorporated therewith.
Figure 3:
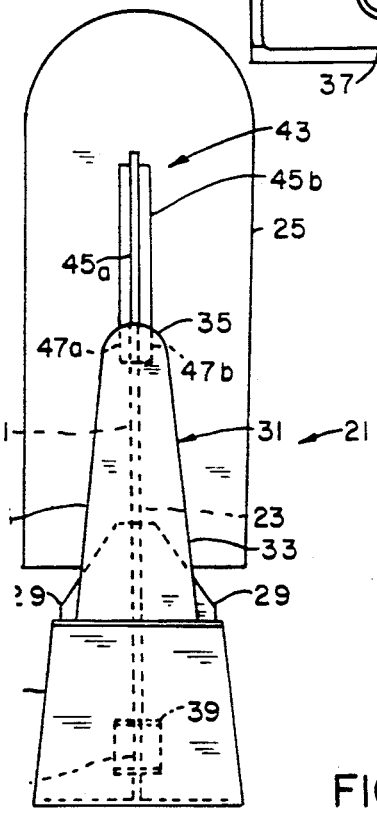
Figure 4:
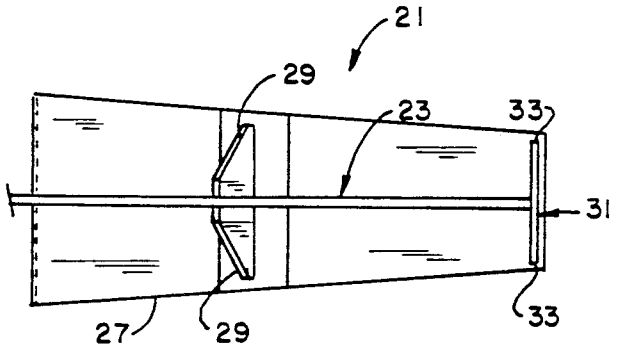
FIG. 4 is a sectional view of the bolster assembly taken along line 4—4 in FIG. 2; and, FIGS. 5 and 6 are respective front and side elevational views of one side a prior art bolster assembly having a lifting arrangement incorporated therewith.

In FIGS. 2–4, an improved bolster assembly of the present invention is indicated at 21. The bolster assembly 21 is for use on a railway tank car T, and replaces the prior art assembly 1 previously described. While only one side of the assembly is shown, it will again be understood that both sides have the same configuration.

Bolster assembly 21 comprises a vertical bolster web member 23, the upper end of which is formed to fit about the outer surface of the shell S forming the tank. Member 23 has a curved upper end, the curvature of which corresponds to the outer wall of shell S. The bolster assembly does not extend so far around the sides of the tank shell so the assembly provides a lower profile than the prior art assembly 1. A cradle 25 is secured to upper surface of bolster web member 23 by welding, for example. The cradle begins at point outwardly of the bolster web member, and extends inwardly beneath tank T and is joined to a cradle pad CP welded to the bottom of the tank with the cradle pad extending inbound toward the center of the tank car. The bolster assembly 21 also includes a bottom cover plate 27 which is secured to the bottom edge of bolster web member 23, also by welding. This bottom cover plate extends from the outer end of bolster web member 23 inwardly and then downwardly to the lower reaches of the bolster web member. Gussets 29 are attached to each side of the bolster web member 23 with the lower end of the gussets attached to the member and to the bottom cover plate 27 at the point where the cover plate angles downwardly. The gussets extend diagonally upwardly and inwardly therefrom. An end cover plate 31 is attached to the outer end of bolster web member 23. The base of cover plate 31 connects with the outer end of bottom cover plate 27. Plate 31 has inwardly sloping sidewalls 33 and a curved top portion 35. The sidewall of member 23 extends upwardly at an initial inward angle which increases in slope toward the upper end of the member. The height of cover plate 31 extends to a point along the sidewall of member 23 where this inward slope increases. Adjacent the lower inner end of member 23 is an opening 37 in which is fitted a trainline sleeve 39.

A hook hole or opening 41 is formed in bolster web member 23 adjacent the upper, outer end of the bolster web member. Opening 41 is an elongate, ovate opening, the size and orientation of which conforms to AAR design specifications. The longitudinal axis of opening 41 is offset from the vertical to facilitate insertion of a lifting hook, as indicated at LH in FIG. 2 in the opening. Further, the position of the opening with respect to the tank shell is such that the pulling angle of the a lifting hook inserted in the opening is reduced. This reduces the stress produced on the bolster assembly during lifting.

The assembly also includes reinforcement means 43 attached to at least one side, and preferably both sides, of bolster web member 23. Reinforcement means 43 includes a pair of flat plates 45a, 45b, respectively. These are welded to the upper end of bolster web member 23, on opposite sides thereof. The plates are generally triangular in shape. The inner end of each plate is contoured to conform to the curvature of the inner end of bolster web member 23. The outer end of each plate is spaced inwardly from the outer, upper end of the bolster web member and has an inward slope corresponding to that of the bolster web member. The lower end of each plate 45a, 45b extends generally horizontally of the member. Each lower end extends across the bolster web member at a point below the upper end of opening 41. A notch 47a, 47b is formed in the lower end of each respective plate 45a 45b. The notch extends upwardly and outwardly from the base of each respective plate and terminates at a point beyond the upper end of opening 41. The longitudinal axis of the notches 47a, 47b overlays that of the opening. However, the width and length of each notch is greater than that of the upper end of the opening so neither reinforcement plate contacts the opening nor is contiguous with or immediately adjacent thereto.

The use of the flat plates 45a, 45b as opposed to the U-shaped member 17 results in a lighter structure than with the previous bolster assemblies 1. At the same time, a hook hole is provided for the cable/hook arrangement employed by a crane used to move the tank car on and off the tracks. Further, while the plates are not touching the sides of the opening, they are close enough to provide adequate reinforcement so the material of member 23 does not tear due to the stresses created when the car is lifted by hooks. As noted, the other side of the bolster assembly for the one end of the car is constructed in the same way as the assembly 21 shown in the drawings and the bolster assembly on the other end of the car is the same as the bolster assembly described herein above.

Numerous variations, within the scope of the appended claims, will be apparent to those skilled in the art in light of the foregoing description and the accompanying drawings.

Having thus described the invention, what is claimed and desired to be secured by Letters Patent is:

1. An improved bolster assembly for a railway tank car wherein each side of the assembly comprises a vertical member including an upper surface formed to fit about an outer surface of a tank of the tank car, said vertical member having an oval opening formed adjacent an outer end of said vertical member and having reinforcement means attached to at least one side of the vertical member at an upper end of the vertical member, said reinforcement means being spaced from the opening and not contiguous to said opening and having a contoured inner face conforming to the outer surface of the tank, an upper end of the opening extending above lower ends of the plates with each plate having a notch surrounding a portion of the opening, said notch being substantially larger than said portion of the opening.

2. An improved bolster assembly for a railway tank car comprising a vertical web member including an upper surface formed to fit about an outer surface of a tank of the tank car, the vertical web member having an elongated oval opening adjacent an outer end of the vertical web member and having a reinforcement plate secured to each side of the vertical web member at an upper end of the vertical web member, an upper end of the opening extending above lower ends of the plates, each said reinforcement plate having a notch surrounding a portion of the opening, said notch being substantially larger than said portion of the opening, whereby the edges of said plates defining said notches are spaced from the edges of said vertical web member defining said opening and are not contiguous with said opening. outer surfaces of said plates having contoured inner faces conforming to the outer surface of the tank, a cover plate attached to a bottom surface of said vertical web member, and a side plate attached to an outer edge of said vertical web member.

3. The bolster assembly of claim 2, further including gusset means attached to each side of the vertical web member and to the cover plate.

4. The bolster assembly of claim 1, further including a cover plate attached to a bottom surface of said vertical member.

5. The bolster assembly of claim 4, further including gusset means attached to each side of said vertical member and to said cover plate.

* * * * *